US005441416A

United States Patent [19]

Gajewski et al.

[11] Patent Number: 5,441,416

[45] Date of Patent: Aug. 15, 1995

[54] TELESCOPING ELECTRICAL CONNECTOR

[75] Inventors: Kenneth J. Gajewski, Woodhaven; Ralph T. Nichols, Romulus, both of Mich.

[73] Assignee: Ford Motor Company, Dearborn, Mich.

[21] Appl. No.: 130,826

[22] Filed: Oct. 4, 1993

[51] Int. Cl.[6] ..... H01R 41/00

[52] U.S. Cl. ..... 439/32; 439/34

[58] Field of Search ..... 439/31, 32, 34; 70/239; 219/203; 49/324, 349, 357, 360; 296/144.2, 144.3, 144.4

[56] References Cited

U.S. PATENT DOCUMENTS

| | | | |
|---|---|---|---|
| 1,558,211 | 10/1925 | Williams . | |
| 2,706,230 | 4/1955 | Bourns et al. | 439/32 X |
| 3,181,094 | 4/1965 | Hotine . | |
| 4,245,873 | 1/1981 | Markowitz . | |
| 4,410,843 | 10/1983 | Sauer et al. | 219/203 X |
| 5,248,259 | 9/1993 | Naito et al. | 439/34 |

FOREIGN PATENT DOCUMENTS

| | | | |
|---|---|---|---|
| 0136850 | 5/1989 | Japan | 70/239 |
| 2242929 | 10/1991 | United Kingdom | 296/196.2 |

*Primary Examiner*—Eugene F. Desmond

*Attorney, Agent, or Firm*—Lorraine S. Melotik; Roger L. May

[57] ABSTRACT

A telescoping electrical connector for an automotive vehicle to provide an electrical connection between a vehicle stationary object and a vehicle moveable object includes a first connector member electrically connected to a vehicle stationary object mounted to vehicle structure and a second connector member electrically connected to a vehicle moveable object moveable relative to the vehicle stationary object, the first and second connector members telescopingly engage each other to provide an electrical connection between and allow electrical power to flow between the vehicle stationary object and the vehicle moveable object.

16 Claims, 1 Drawing Sheet

FIG 1
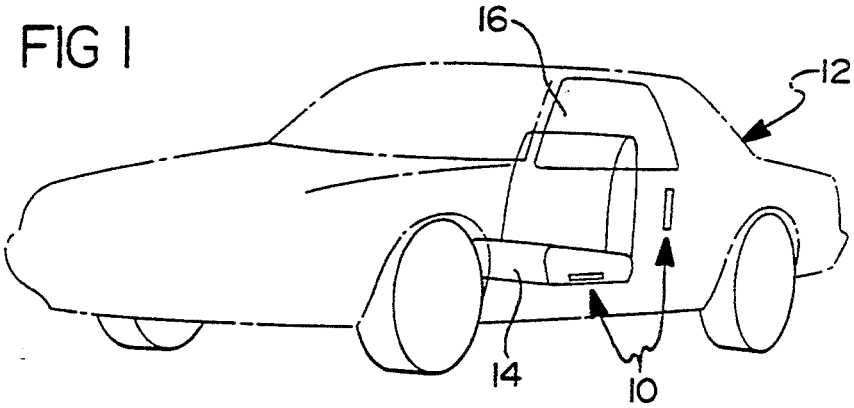
FIG 2
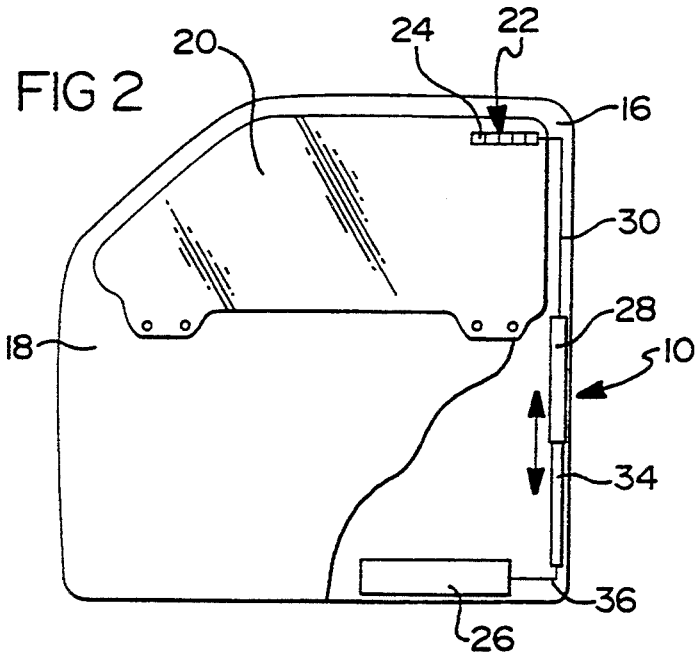
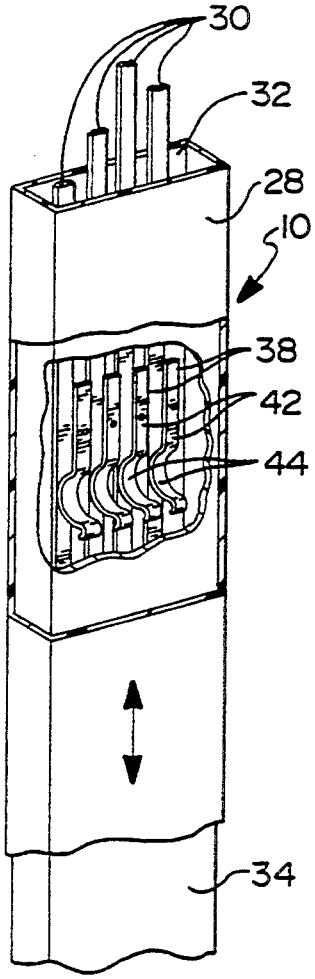
FIG 3
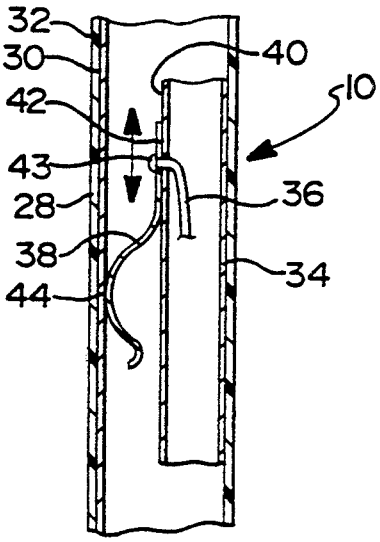
FIG 4

TELESCOPING ELECTRICAL CONNECTOR

BACKGROUND OF THE INVENTION

1. Field of the Invention

The present invention relates generally to electrical connectors and, more specifically, to a telescoping electrical connector for an automotive vehicle.

2. Description of the Related Art

It is known to provide electrical connectors for connecting electrical wires between a power source and a stationary object. Typically, the electrical connector includes a first connector member and a second connector member which are coupled together. In an automotive vehicle application, the electrical connector may be used for a keyless entry system. For example, the first connector member may be connected by electrical wires to a stationary keypad on a vehicle door and a second connector member connected by electrical wires to a stationary decoder module and power source within the vehicle. The first and second connector members are coupled together to provide an electrical connection and conduct an electrical signal between the keypad and the decoder module and power source such that an operator may push on the keypad to communicate with an electronic controller to unlock the vehicle door.

One disadvantage of the above electrical connector is that it is only used to provide an electrical connection between stationary objects in an automotive vehicle. Therefore, there is a need in the art to provide an electrical connector that can provide an electrical connection between a stationary object and a moveable object in an automotive vehicle.

SUMMARY OF THE INVENTION

Accordingly, the present invention is an electrical connector for an automotive vehicle to provide an electrical connection between a vehicle stationary object and a vehicle moveable object. The electrical connector includes a first connector member electrically connected to a vehicle stationary object mounted to vehicle structure and a second electrical connector electrically connected to a vehicle moveable object moveable relative to the vehicle stationary object. The first and second connector members telescopingly engage each other to provide an electrical connection therebetween and allow electrical power to flow between the vehicle stationary object and the vehicle moveable object.

Also, the present invention is an electrical connector for an automotive vehicle to provide an electrical connection between a vehicle keypad and a vehicle decoder module. The electrical connector includes a first connector member electrically connected to a vehicle decoder module mounted to vehicle structure and a second electrical connector electrically connected to a vehicle keypad moveable relative to the vehicle structure. The first and second connector members telescopingly engage each other to provide an electrical connection therebetween and allow an electrical signal to flow between the vehicle keypad and the vehicle decoder module.

One advantage of the present invention is that a telescoping electrical connector is provided for allowing an electrical connection between a stationary and a moveable object. Another advantage of the present invention is that the telescoping electrical connector may be used for a keyless entry system to provide an electrical signal from a keypad on a moveable glass panel of an automotive vehicle to a stationary discriminator module mounted within the vehicle. Yet another advantage of the present invention is that the telescoping electrical connector maintains an electrical connection between the discriminator module and the keypad at all times while the glass panel moves up and down or remains stationary. A further advantage of the present invention is that the telescoping electrical connector is stored inside of the vehicle door.

Other features and advantages of the present invention will be readily appreciated as the same becomes better understood after reading the subsequent description taken in conjunction with the accompanying drawings.

BRIEF DESCRIPTION OF THE DRAWINGS

FIG. 1 is a perspective view of a telescoping electrical connector, according to the present invention, illustrated in operational relationship with an automotive vehicle.

FIG. 2 is a fragmentary elevational view of the telescoping electrical connector of FIG. 1 illustrated in operational relationship with a door of the automotive vehicle of FIG. 1.

FIG. 3 a fragmentary perspective view of the telescoping electrical connector of FIGS. 1 and 2.

FIG. 4 is a fragmentary elevational view of the telescoping electrical connector of FIGS. 1 and 2.

DESCRIPTION OF THE PREFERRED EMBODIMENT(S)

Referring to the drawings and in particular FIG. 1, a telescoping electrical connector 10 is illustrated in operational relationship with an automotive vehicle, generally indicated at 12. The telescoping electrical connector 10 may be used to provide an electrical connection between a stationary object and a moveable object such as a seat 14 or a door 16 of the automotive vehicle 12 as will be described. It should be appreciated that the seat 14 and door 16 are conventional and known in the art.

Referring to FIG. 2, the door 16 includes a housing 18 formed by inner and outer door panels joined together and a moveable glass panel 20 which moves or slides within the housing 18. Alternatively, the door 16 may be constructed such that an edge of the glass panel 20 is exposed on the vehicle exterior by eliminating an exterior portion of a window frame (not shown) for the glass panel 20 to allow a more flush fit between glass and body sheet metal (i.e., "hard top" look). The door 16 also includes a window mechanism (not shown) for moving the glass panel 20 up and down relative to the housing 18.

The door 16 may include a keyless entry system, generally indicated at 22, for allowing a latch mechanism (not shown) to lock and unlock the door 16. The keyless entry system 22 includes a keypad 24 mounted on the glass panel 20 by suitable means such as an adhesive. Preferably, the keypad 24 is a piezoelectric switch which is pressure sensitive and gives off electrical voltage pulses or signals when contacted by an operator. The keyless entry system 22 also includes an electronic controller or discriminator box or module 26 which is fixedly mounted inside the housing 18 of the door 16 or to other vehicle structure such as a body panel by suitable means such as fasteners (not shown). The keypad 24 supplies electrical power or signals to the discriminator module 26 and converts the signals to ON/OFF signals. It should be appreciated that the discriminator module 26 is conventional and known in the art. It should also be appreciated that the telescoping electrical connector 10 interconnects the keypad 24 and discriminator module 26.

The telescoping electrical connector 10 includes a first or top connector member 28 connected by, at least one, preferably a plurality of bus bars 30 to the keypad 24. The first connector member 28 is a tubular member having a generally rectangular shape, although any suitable shape such as circular may be used. The first connector member 28 is made of a plastic material although any suitable material may be used. The bus bars 30 are strips which extend longitudinally and are spaced laterally on an inner surface 32 of the first connector member 28. Preferably, the bus bars 30 extend the entire length of the inner surface 32 of the first connector member 28. The bus bars 30 are made of a metal material such as copper although any suitable material such as brass, gold or conductive frit or epoxy may be used. The bus bars 30 are conventional and secured to the first connector member 28 and glass panel 20 by suitable means such as silk screening or an adhesive. It should be appreciated that the first connector member 28 and bus bars 30 move simultaneously with the glass panel 20.

The telescoping electrical connector 10 also includes a second or bottom connector member 34 connected to the discriminator box 26 by electrical wires 36. The second connector member 34 is a tubular member having a generally rectangular shape although any suitable shape such as circular may be used. The second connector member 34 is disposed in telescoping relationship and slides within the first connector member 28. The second connector member 34 is made preferably of a plastic material although any suitable material may be used.

The second connector member 34 also includes at least one, preferably a plurality of pressure contacts 38 which extend longitudinally and are spaced laterally on an outer surface 40 thereof to correspond with the bus bars 30 of the first connector member 28. The pressure contacts 38 have a base portion 42 extending longitudinally and secured to the second connector member 34 by suitable means such as rivets 43. The pressure contacts 38 have an inverted arcuate or "U" shape contact portion 44 extending longitudinally from the base portion 42 to contact the bus bars 30. The base portion 42 and contact portion 44 act as a spring to provide sliding pressure contact with the bus bars 30. The pressure contacts 38 are made of a metal material such as copper although any suitable material such as brass or gold may be used. It should be appreciated that the pressure contacts 38 are connected to the electrical wires 36 by the rivets 43.

In operation, the keypad 24, bus bars 30 and first connector member 28 are mounted on a backside of the glass panel 20. A portion of the bus bars 30 and first connector member 28 are disposed within the housing 18 of the door 16. The discriminator module 26 and second connector member 34 are disposed within and secured to the housing 18 of the door 16. The second connector member 34 is disposed within the first connector member 28 such that the pressure contacts 38 contact the bus bars 30. As the glass panel 20 moves up and down relative to the housing 18, the first connector member 28 moves relative to the second connector member 34 such that the bus bars 30 slide relative to the pressure contacts 38. The keypad 24 provides electrical power or signals to the discriminator module 26 which receives the electrical signals from the keypad 24 due to the sliding engagement between the bus bars 30 and pressure contacts 38. It should be appreciated that the telescoping electrical connector 10 may have more than two connector members in telescoping engagement. It should also be appreciated that the bus bars 30 and pressure contacts 38 may be reversed and be disposed on the second connector member 34 and first connector member 28, respectively. It should further be appreciated that the telescoping electrical connector 10 may be used for other moveable objects such as the seat 14 of the automotive vehicle 12.

Accordingly, the telescoping electrical connector 10 provides an electrical connection between stationary and moveable objects. The telescoping electrical connector 10 also allows electrical power or signals to flow from a keypad 24 on a moveable glass panel 20 to a stationary discriminator module 26 mounted to vehicle structure.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A telescoping electrical connector for an automotive vehicle to provide an electrical connection between a vehicle stationary object and a vehicle moveable object comprising:

a tubular first connector member electrically connected to a vehicle stationary object mounted to vehicle structure;

a tubular second connector member electrically connected to a vehicle moveable object moveable relative to the vehicle stationary object;

means for conducting electrical power between said first and second connector members; and said first and second connector members disposed telescopingly within one another and slidingly engaging each other during entire movement of the vehicle moveable object relative to the vehicle stationary object to provide an electrical connection therebetween and allow electrical power to flow between the vehicle stationary object and the vehicle moveable object.

2. A telescoping electrical connector for an automotive vehicle to provide an electrical connection between a vehicle stationary object and a vehicle moveable object comprising:

a tubular first connector member electrically connected to a vehicle stationary object mounted to vehicle structure;

a tubular second connector member electrically connected to a vehicle moveable object moveable relative to the vehicle stationary object;

means for conducting electrical power between said first and second connector members;

said first and second connector members telescopingly engaging each other to provide an electrical connection therebetween and allow electrical power to flow between the vehicle stationary object and the vehicle moveable object; and wherein said conducting means comprises at least one bus bar on either one of said first and second connector members and at least one pressure contact on the other one of said first and second connector members, said at least one pressure contact engaging said at least one bus bar.

3. A telescoping electrical connector as set forth in claim 2 wherein said at least one bus bar is a strip extending longitudinally and secured to a surface of said connector member.

4. A telescoping electrical connector as set forth in claim 2 wherein said at least one pressure contact has a base portion extending longitudinally and a contact portion extending longitudinally from said base portion to contact said at least one bus bar.

5. A telescoping electrical connector as set forth in claim 4 wherein said contact portion has a generally arcuate shape.

6. A telescoping electrical connector as set forth in claim 4 including means for securing said base portion to a surface of said connector member.

7. A telescoping electrical connector as set forth in claim 6 wherein said securing means comprises a rivet.

8. A telescoping electrical connector for a keyless entry system on an automotive vehicle to provide an electrical connection between a discriminator module and a keypad comprising:

a first connector member electrically connected to a discriminator module mounted to vehicle structure;

a second connector member electrically connected to a keypad mounted on a glass panel moveable relative to the discriminator module;

means for conducting electrical signals between said first and second connector members; and said first and second connector member telescopingly engaging each other to provide an electrical connection therebetween and allow an electrical signal to flow between the keypad and discriminator module.

9. A telescoping electrical connector as set forth in claim 8 wherein said first and second connector members are tubes.

10. A telescoping electrical connector as set forth in claim 8 wherein said conducting means comprises at least one bus bar on either one of said first and second connector members and at least one pressure contact on the other one of said first and second connector members, said at least one pressure contact engaging said at least one bus bar.

11. A telescoping electrical connector as set forth in claim 10 wherein said at least one bus bar is a strip extending longitudinally and secured to an inner surface of the one of said first and second connector members.

12. A telescoping electrical connector as set forth in claim 10 wherein said at least one pressure contact has a base portion extending longitudinally and a contact portion extending longitudinally from said base portion to contact said at least one bus bar.

13. A telescoping electrical connector as set forth in claim 11 wherein said contact portion has a generally arcuate shape.

14. A telescoping electrical connector as set forth in claim 12 including means for securing said base portion to a surface of said connector member.

15. A telescoping electrical connector as set forth in claim 13 wherein said securing means comprises a rivet.

16. A telescoping electrical connector for a keyless entry system on an automotive vehicle to provide an electrical connection between a discriminator module and a keypad comprising:

a first connector member electrically connected to a discriminator module mounted within a vehicle door;

a second connector member electrically connected to a keypad mounted on a glass panel moveable relative to the discriminator module;

said first and second connector member telescopingly engaging each other to provide an electrical connection therebetween and allow electrical signals to flow between the keypad and discriminator module;

at least one bus bar on said first connector member and at least one pressure contact on said second connector member, said at least one pressure contact engaging said at least one bus bar; and wherein said first and second connector members are tubular members.

* * * * *